US005836406A

United States Patent [19]

Schuh

[11] Patent Number: 5,836,406

[45] Date of Patent: Nov. 17, 1998

[54] ADJUSTABLE STABILIZER FOR DIRECTIONAL DRILLING

[75] Inventor: Frank J. Schuh, Plano, Tex.

[73] Assignee: Telejet Technologies, Inc., Dallas, Tex.

[21] Appl. No.: 882,798

[22] Filed: Jun. 26, 1997

Related U.S. Application Data

[63] Continuation of Ser. No. 757,139, Dec. 3, 1996, abandoned, which is a continuation of Ser. No. 446,006, May 19, 1995, abandoned.

[51] Int. Cl.[6] ..... E21B 7/04

[52] U.S. Cl. ..... 175/61; 175/74; 175/76; 175/107; 175/325.3

[58] Field of Search ..... 175/61, 73, 74, 175/76, 107, 325.1–325.3

[56] References Cited

U.S. PATENT DOCUMENTS

| | | | |
|---|---|---|---|
| 3,092,188 | 6/1963 | Farris et al. | 175/76 |
| 3,545,825 | 12/1970 | Hamilton | 308/6 |
| 3,593,810 | 7/1971 | Fields | 175/76 |
| 3,595,326 | 7/1971 | Claycomb | 175/73 |
| 4,105,262 | 8/1978 | Richey | 308/4 |
| 4,131,167 | 12/1978 | Richey | 175/323 |
| 4,270,618 | 6/1981 | Owens | 175/57 |
| 4,394,881 | 7/1983 | Shirley | 175/76 |
| 4,600,063 | 7/1986 | Beasley | 175/325 |
| 4,635,736 | 1/1987 | Shirley | 175/76 |
| 4,638,873 | 1/1987 | Welborn | 175/73 |
| 4,754,821 | 7/1988 | Swietlik | 175/325 |
| 4,947,944 | 8/1990 | Coltman et al. | 175/73 |
| 4,951,760 | 8/1990 | Cendre et al. | 175/269 |
| 5,038,872 | 8/1991 | Shirley | 175/76 |
| 5,050,692 | 9/1991 | Beimgraben | 175/61 |
| 5,070,950 | 12/1991 | Cendre et al. | 175/741 |
| 5,139,094 | 8/1992 | Prevedel et al. | 175/616 |
| 5,181,576 | 1/1993 | Askew et al. | 175/61 |
| 5,265,684 | 11/1993 | Rosenhaunce | 175/61 |
| 5,293,945 | 3/1994 | Rosenhaunch et al. | 175/325.2 |
| 5,311,953 | 5/1994 | Walker | 175/61 |
| 5,318,137 | 6/1994 | Johnson et al. | 175/40 |
| 5,318,138 | 6/1994 | Dewey et al. | 175/74 |
| 5,332,048 | 7/1994 | Underwood et al. | 175/26 |

FOREIGN PATENT DOCUMENTS

| | | | |
|---|---|---|---|
| 3564662 A1 | 9/1987 | Germany | E21B 7/20 |
| WO 93/12319 | 6/1993 | WIPO | E21B 7/04 |
| WO 93/18273 | 9/1993 | WIPO | E21B 7/06 |

OTHER PUBLICATIONS

IADC/SPE 27484, Underwood, L.D., Odell II, A.C. "A Systems Approach to Downhole Adjustable Stabilizer Design," 1994, pp. 475–488.

SPE 24611, Warren, T.M, et al. "Short–Radius Lateral Drilling System," 1992, pp. 693–705.

SPE/IADC 25759, Chur, C., Oppelt, J., "Vertical Drilling Technology: A Milestone in Directional Drilling," 1993, pp. 789–801.

"Steerable Roatry Drilling With an Experimental System," J.D. Barr et al., SPE/IADC 29382, pp. 435–450, 1995.

*Primary Examiner*—Roger J. Schoeppel
*Attorney, Agent, or Firm*—Kenneth C. Hill

[57] ABSTRACT

A stabilizer body is rotatably carried by the stabilizer sub, wherein the stabilizer body remains substantially stationary relative to the borehole as the drillstring rotates. At least one stabilizer blade is carried by the stabilizer body, the stabilizer blade being radially extendable from the stabilizer body and into engagement with the sidewall of the borehole. Each stabilizer blade is extendable and retractable from the stabilizer body independently of the others.

17 Claims, 3 Drawing Sheets

ADJUSTABLE STABILIZER FOR DIRECTIONAL DRILLING

This is a continuation of application Ser. No. 08/757,139, filed Dec. 3, 1996, now abandoned, which is a continuation of application Ser. No. 08/446,006, filed May 19, 1995, now abandoned.

BACKGROUND OF THE INVENTION

1. Field of the Invention

The present invention relates generally to apparatus for use in drilling directional boreholes. More specifically, the present invention is related to stabilizer assemblies carried by a drillstring for altering the direction of drilling from vertical.

2. Background Information

The earliest efforts to drill directionally for petroleum hydrocarbons employed mechanical whipstocks, which were used to deflect a rotating drillstring from vertical in a previously vertical wellbore. The chief drawback to the use of whipstocks is that directional control of the bit and drillstring is lost once the drillstring is kicked off or deflected by the whipstock. Additionally, whipstock operations are time-consuming and therefore expensive.

Another method of directional drilling employs the use of a bent or bendable sub in connection with a downhole motor or turbine. The bent sub has a bend formed therein to position the drill bit a few degrees from the vertical axis of the remainder of the drillstring. A downhole motor is coupled between the bent sub and drill bit or is incorporated in the bent sub itself. The drillstring and downhole motor may be rotated to cause the bit to disintegrate formation and drill straight ahead at the same angle and azimuth of the existing borehole. When it is desirable to alter the direction of drilling, rotation of the drillstring is stopped and the bit is rotated by the drilling motor. This mode of operation is known as the "sliding" mode, because the drillstring is sliding rather than rotating with respect to the sidewall of the borehole. In the deviated portion of the borehole, the drillstring experiences sufficient frictional contact with the sidewall of the borehole to make it difficult to apply significant weight to the bit, resulting in reduced rates of penetration compared to rotary drilling. Examples of bent sub or motor directional drilling systems and method are disclosed in U.S. Pat. No. 5,311,953, May 17, 1994 to Walker; U.S. Pat. No. 5,139,094, Aug. 18, 1992 to Prevedel et al; and U.S. Pat. No. 5,050,692, Sep. 24, 1991 to Beimgraben.

In another directional drilling system and method, a pair of stabilizers are provided in the drillstring and are spacedapart above the drill bit. The difference in diameter between the upper stabilizer and the near-bit stabilizer, whether adjustable or fixed, and the spacing between the stabilizers, provide lateral forces that assist in deflecting the bit from the vertical axis of the borehole. Such stabilizer arrangements are employed in both rotary drilling and downhole motor arrangements. If the stabilizers are adjustable and employed in surface rotation drilling, each stabilizer blade must extend from the stabilizer body the same distance to maintain symmetry and avoid eccentricity and associated rough running. If drilling is accomplished with a drilling motor, no such limitation is imposed on upper stabilizer, above the drilling motor, because it is not rotated. Examples of stabilizer arrangements are found in U.S. Pat. No. 5,332,048, Jul. 26, 1994 to Underwood et al; U.S. Pat. No. 5,293,945, Mar. 15, 1994, to Rosenhauch et al.; U.S. Pat. No. 5,181,576, Jan. 26, 1993 to Askew et al.; and U.S. Pat. No. 4,754,821, Jul. 1, 1988 to Swietlik.

A variation on the adjustable stabilizer theme is to provide stabilizer bodies having fixed stabilizer blades, but having pistons acting between the drillstring or stabilizer sub and the fixed stabilizer bodies to introduce eccentricities between the upper and lower stabilizers and resulting lateral deflection forces. These arrangements require multiple piston actuations per revolution of the drillstring and thus present mechanical and reliability disadvantages. Examples of such arrangements can be found in U.S. Pat. No. 5,038,872, Aug. 13, 1991 to Shirley and U.S. Pat. No. 3,593,810, Jul. 20, 1971 to Fields.

A needs exists, therefore, for a directional drilling assembly or system for use with an efficient rotating drillstring that permits the driller to control precisely the trajectory of the bit during drilling operation.

SUMMARY OF THE INVENTION

It is a general object of the present invention to provide an improved assembly for steering a rotating drillstring in a borehole.

This and other objects of the present invention are accomplished by providing a stabilizer sub for attachment into a drillstring proximal to a drill bit. A stabilizer body is rotatably carried by the stabilizer sub, wherein the stabilizer body remains substantially stationary relative to the borehole as the drillstring rotates. At least one stabilizer blade is carried by the stabilizer body, the stabilizer blade being radially extendable from the stabilizer body and into engagement with the sidewall of the borehole.

According to the preferred embodiment of the present invention, at least three stabilizer blades are spaced apart on the circumference of the stabilizer body. Each stabilizer blade is selectively extendable and retractable independently of the others.

According to the preferred embodiment of the present invention, each stabilizer blade is carried in a longitudinal slot in the stabilizer body, the slot having an inclined bottom such that relative longitudinal movement between the stabilizer blade and stabilizer body causes extension or retraction of the stabilizer blade. A motor is coupled between each stabilizer blade and the stabilizer body to cause relative longitudinal movement therebetween.

According to the preferred embodiment of the present invention, the stabilizer sub includes a fixed stabilizer at an end opposite the drill bit. A lead screw couples the motor to the stabilizer blade, wherein rotation of the lead screw by the motor cause the relative longitudinal movement.

DESCRIPTION OF THE PREFERRED EMBODIMENT

Figure 1:
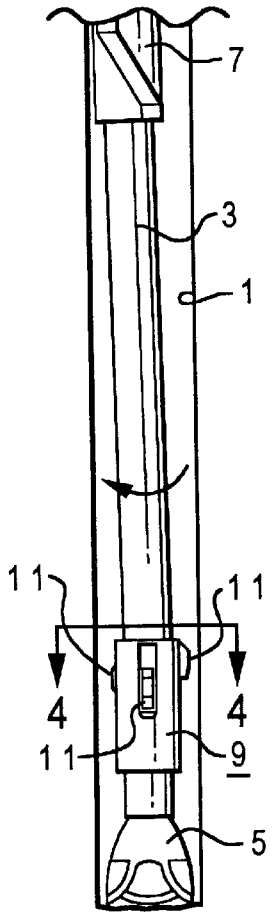
FIG. 1 is a longitudinal section view of a borehole illustrating the steering assembly according to the present invention.

Referring now to the Figures, and specifically to FIG. 1, a longitudinal section view of a borehole 1 having a steering assembly disposed therein is depicted. Steering assembly includes a stabilizer sub 3, which is conventionally connected by a threaded tool joint into a conventional rotary drillstring (not shown). A drill bit 5, of either the fixed or rolling cutter variety, is secured to the lowermost end of stabilizer sub 3. A fixed stabilizer 7 is carried by stabilizer sub 3 and spaced apart from bit 5. An adjustable stabilizer 9, including a plurality of stabilizer blades 11, is carried by stabilizer sub 3 at its lower end, near drill bit 5. Alternatively, upper stabilizer 7 can be an adjustable stabilizer, as well, further increasing the versatility of the steering assembly according to the present invention.

Figure 2:
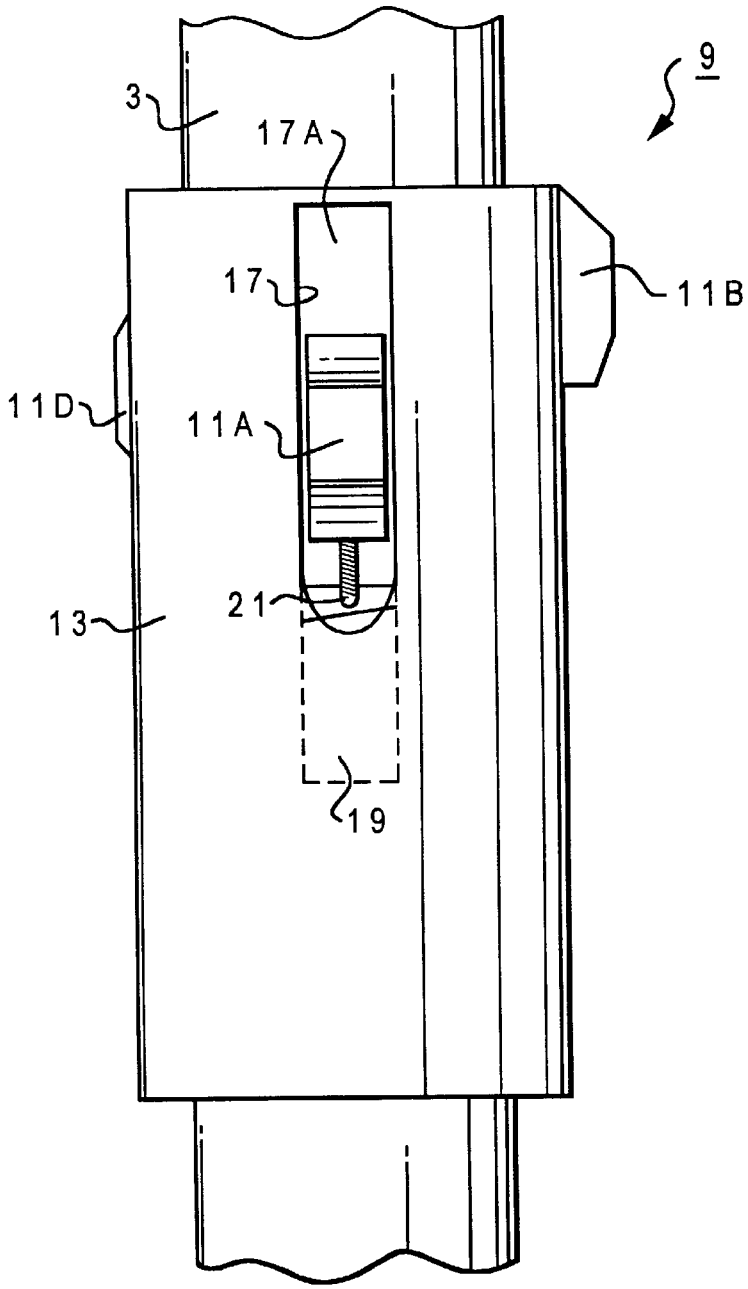
FIG. 2 is an elevation view of the stabilizer portion of the improved steering assembly of FIG. 1.
Figure 3:
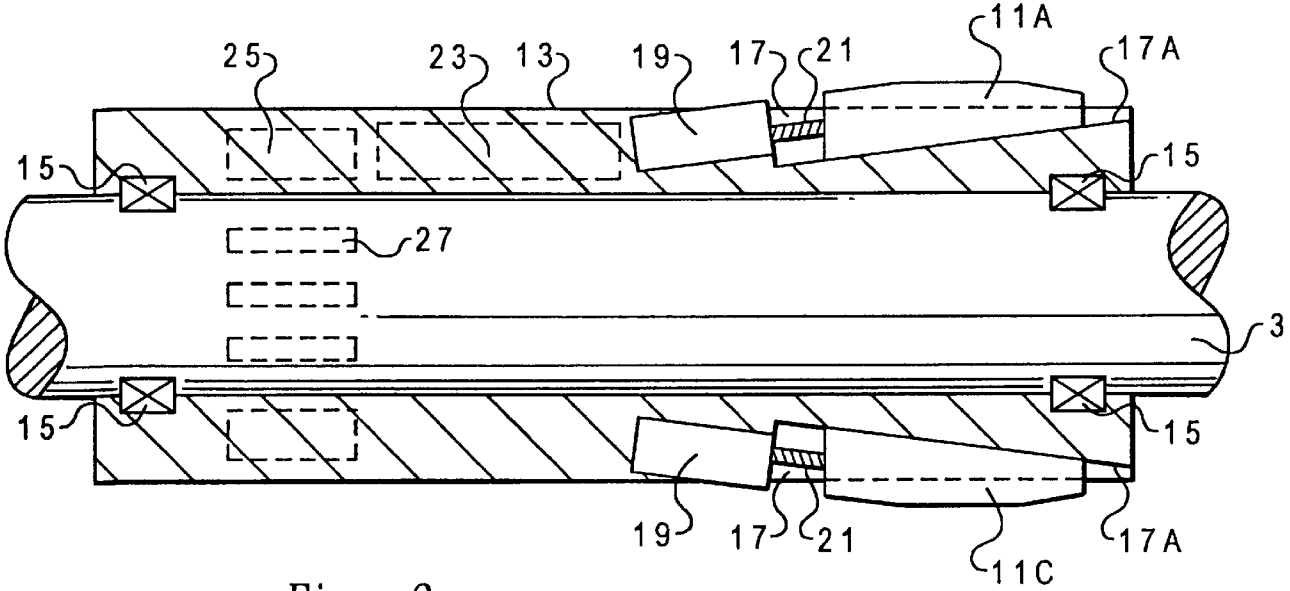
FIG. 3 is a longitudinal section view of the stabilizer portion of FIG. 2.

FIGS. 2 and 3 are elevation and longitudinal section views, respectively, of adjustable stabilizer 9 of the steering assembly according to the present invention. A generally cylindrical stabilizer body 13 is coupled to the exterior of generally cylindrical stabilizer sub 3 by bearings and seals 15, which permit stabilizer body 13 to rotate relative to stabilizer sub 3 and retain lubricant in the annular gap therebetween. According to the preferred embodiment of the present invention, at least four stabilizer blades 11A, 11B, 11C, 11D are received in longitudinal slots 17 in stabilizer body 13 and are retained therein by a tongue-and-groove arrangement. Each longitudinal slot 17 has an inclined bottom 17A, which defines a ramp wherein relative longitudinal movement between the stabilizer blades 11A–11D and ramp 17A causes radial expansion or retraction of stabilizer blades 11A–11D from stabilizer body 13. Associated with each slot 17 is a one-half horsepower electric motor 19. Motor 19 rotates a lead screw 21, which engages a ball nut (not shown) carried in each stabilizer blade 11A–11D to cause the relative longitudinal movement. According to the preferred embodiment of the present invention, each lead screw 21 is designed to yield when stabilizer 9 is subjected to axial sticking loads of 10,000 pounds per stabilizer blade to prevent adjustable stabilizer 9 from causing the drillstring to stick in the borehole. Because each stabilizer blade 11A–11D is provided with its own actuator, in the form of motor 19 and lead screw 21, the stabilizer blades are independently extendable and retractable with respect to stabilizer body 13. Motors 19 are preferably are stepper or servo motors adapted to control precisely the rotation of lead screws 21 and the extension of each stabilizer blade 11A–11D from stabilizer body 13.

A microprocessor or control unit 23 is coupled to each motor 19 to control the rotation of motor 19 and lead screw 21, and thus the extension of stabilizer blades 11A–11D from stabilizer body 13. Microprocessor 23 carried in stabilizer body 13 contains conventional means for reading position data from encoders associated with each motor 19 to ascertain the extension of each stabilizer blade 11A–11D. Microprocessor or controller 23 and motors 19 are powered by a battery 25 carried in stabilizer body 13. Battery 25 preferably is charged by inductive coupling with a plurality of charging coils 27 circumferentially spaced in stabilizer sub 3. Charging coils 27 preferably are energized by a conventional drilling-fluid-powered generator carried by stabilizer sub 3 or a separate measurement-while-drilling (MWD) apparatus elsewhere in the drillstring.

FIGS. 4A–4D are cross section views of borehole 1 and stabilizer body 13 and blades 11A–11D, taken along section line 4—4 of FIG. 1, depicting various configurations of stabilizer blades 11A–11D having varying effects on the trajectory of drill bit 5. For convenience, upper stabilizer blade is labeled 11A, right stabilizer blade is labeled 11B, bottom stabilizer blade is labeled 11C, and left stabilizer blade is labeled 11D.

Figure 4B:
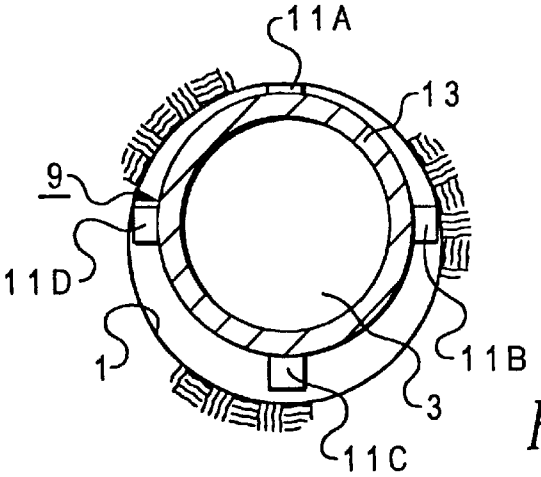
FIGS. 4A–4D are cross section view of the borehole and steering assembly, taken along section lines 4—4 of FIG. 1.
Figure 4D:
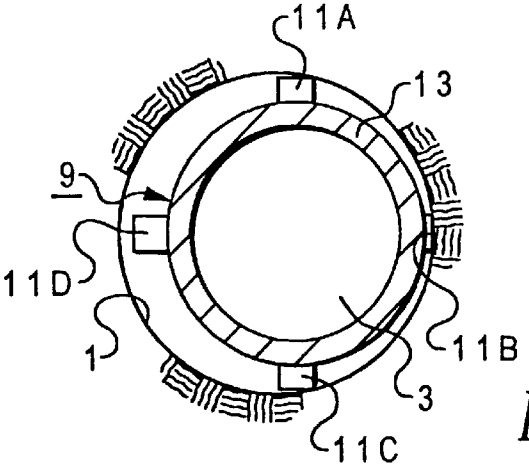
Figure 4A:
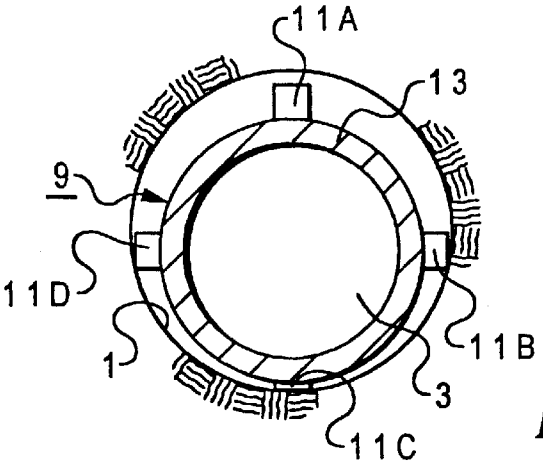

In FIG. 4A, stabilizer assembly 9 is configured to drop angle, or reduce the amount of deviation or deflection from vertical. In this configuration, upper stabilizer blade 11A is extended beyond stabilizer body 13 and into contact or engagement with the sidewall of borehole 1, while bottom stabilizer blade 11C is near fully retracted. According to the preferred embodiment of the present invention, opposing stabilizer blades 11A, 11C are extendable to a diameter larger than the gage of the bit 5 or borehole 1. Of course, opposing stabilizer blades 11A, 11C are never simultaneously fully extended to avoid sticking in borehole 1. The same applies for opposing stabilizer blades 11B, 11D, which, in the drop angle configuration, are extended to an intermediate degree less than the gage of bit 5 and borehole 1.

In FIG. 4B, stabilizer 9 is depicted in a configuration to build angle, or increase the amount of deviation or deflection from vertical in borehole 1. In this configuration, bottom stabilizer blade 11C is near fully extended and upper stabilizer blade 11A is near fully retracted. Again, right and left stabilizer blades 11B, 11D are extended to an intermediate degree less than the gage of bit 5 and borehole 1.

Figure 4C:
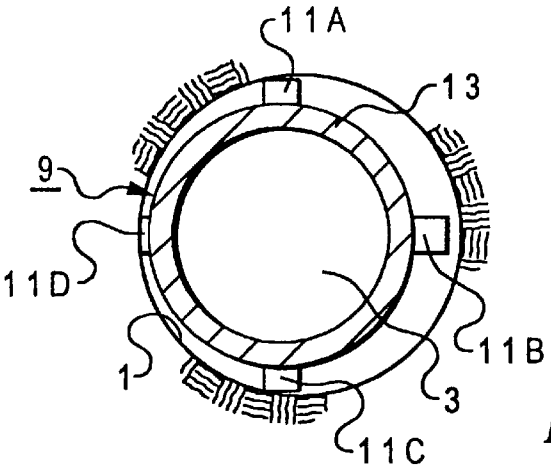

FIG. 4C illustrates stabilizer 9 in a configuration for turning bit 5 to the left in which right stabilizer 11B is near fully extended and left stabilizer blade 11D is retracted, permitting changes in the azimuth of bit 5. Upper and lower stabilizer blades 11A, 11C are extended to an intermediate degree less than the gage of bit 5 and borehole 1 to hold angle.

Similarly, FIG. 4D depicts stabilizer 9 in a configuration to turn bit 5 left in which right stabilizer blade 11D is near fully extended and right stabilizer blade 11B is near fully retracted, while upper and lower stabilizer blades 11A, 11C are extended to an intermediate degree to hold angle.

While FIGS. 4A–4D depict only four of the configurations of stabilizer 9 of the steering assembly according to the present invention, because each stabilizer blade 11A–11D is extendable independently of the others, a virtually infinite variety of stabilizer configurations and bit trajectories are possible. Of course, the virtually infinite adjustability of stabilizer 9 is made possible by coupling stabilizer body 13 for rotation to stabilizer sub 3, wherein it remains substantially stationary relative to borehole 1 as the drillstring rotates. This permits the differential or asymmetric extension of stabilizer blades 11A–11D, which, in turn, permits the wide range of trajectories achieved by the various configurations of stabilizer 9.

Of course, stabilizer body 13 cannot be expected to remain entirely stationary with respect to the sidewall of the borehole. Friction encountered between the inner diameter of stabilizer body 13 and the outer diameter of stabilizer sub 3 is less than that between stabilizer blades 11A–11D and the sidewall of the borehole such that stabilizer body 13 makes approximately one revolution for each 100 to 500 feet drilled. As this slow rotation occurs, upper stabilizer 11A will tend to move toward the orientation of right stabilizer 11B and the same is true of stabilizer blades 11C and 11D. As the orientation of stabilizer blades 11A–11D changes with respect to the sidewall of borehole 1, corrections must be made to maintain the trajectory of bit 5 on the desired course. A three-axis accelerometer with each accelerometer aligned on orthogonal axes is carried by stabilizer body 13 and coupled to microprocessor 23 permits measurement of the inclination angle of stabilizer body 13 and the rotational orientation of stabilizer body 13 and blades 11A–11D. Microprocessor 23 is programmed to correct for changes in orientation of stabilizer sub 13 automatically, or can, through MWD apparatus, communicate this information to the surface for appropriate response. If MWD apparatus is employed, an AM radio transceiver (not shown) is carried by stabilizer body 13 to provide two-way radio communication between microprocessor 23 and the telemetry section of the MWD apparatus, which in turn may be in communication with the surface through one of several conventional telemetry or hardwire techniques.

Similarly, it is frequently advantageous to purposefully alter the configuration of stabilizer 9 to correct for unanticipated alternations in bit trajectory due to unexpected changes in the formation material, the drilling characteristics of bit 5 and the like. Thus, the appropriate configuration for stabilizer 9 is determined at the surface or is preprogrammed into microprocessor 23 or an MWD apparatus in the drillstring that is in communication with microprocessor 23. Motors 19, lead screws 21, and stabilizer blades 11A–11D then are adjusted appropriately for the desired trajectory or trajectory correction.

Figure 5:
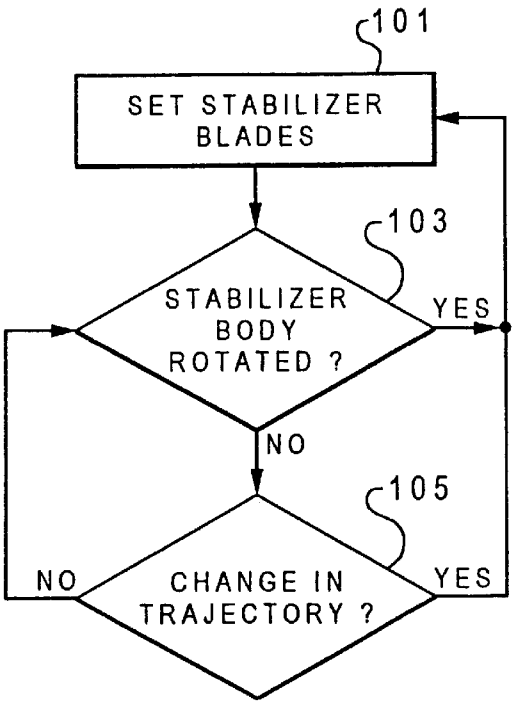
FIG. 5 is a flowchart depicting the operation and control of the adjustable stabilizer of the steering assembly of FIG. 1.

FIG. 5 is a flowchart depicting the control sequence and operation of the steering assembly according to the present invention. With reference to FIGS. 1–5, the operation of the steering assembly according to the present invention will be described. First, a bit is made up into a drillstring to drill an interval of vertical borehole to the kick-off or deflection point at which it is desired to commence directional drilling. If the kick-off point is sufficiently shallow so as not to deplete the life of the drill bit prior to or shortly after kickoff, the vertical drillstring can include stabilizer sub 3, along with fixed and adjustable stabilizers 7, 9. In the vertical section of the borehole, stabilizer blades 11A–11D are fully retracted or positioned at an extension less than the gage of bit 5 and borehole 1, wherein stabilizers 7, 9 simply function as centralizers.

At the kick-off point, stabilizer 9 and stabilizer blades 11A–11D are set in the configuration adapted for the kick-off trajectory, as reflected at step 101 of FIG. 5. The controlled misalignment caused by spaced-apart stabilizers 7, 9 causes deflection of stabilizer sub 3 and bit 5 from the vertical axis of borehole 1, and directional drilling is commenced.

As reflected at step 103 of FIG. 5, stabilizer body 13 is monitored by microprocessor 23 alone or together with MWD apparatus, which may be in communication with the surface, for rotation relative to borehole 1. If rotation of stabilizer body 13 is detected, this information is communicated to or through microprocessor 23, which takes corrective action to readjust the configuration of stabilizer blades 11A–11D to compensate for rotation of stabilizer body 13 in borehole 1.

If no rotation of stabilizer body 13 is detected, at step 105 in FIG. 5, it is determined whether a change of trajectory is desired. Such a change in trajectory is programmed in microprocessor 23 and triggered by measurements from the accelerometers carried by stabilizer body 13, or by survey data from an MWD apparatus that indicates a change in trajectory is appropriate, or may be communicated to microprocessor 23 via telemetry from the surface when there is a surface-detected or monitored indication that a change in trajectory is warranted.

As reflected by the flowchart of FIG. 5, if neither rotation of stabilizer body 13 is detected nor is a trajectory charge or correction warranted, microprocessor 23 continues to monitor both conditions for appropriate response in the event of the occurrence of either condition.

The present invention provides a number of advantages over prior-art steering assemblies and systems. A principal advantage is that the steering system is adapted for use with efficient surface-rotation drilling techniques and their associated high rates of penetration. The steering assembly according to the present invention does not require complex hydraulic and mechanical systems to effect deflection of the bit or changes in its trajectory during drilling operation.

The invention has been described with reference to a preferred embodiment thereof. It is thus not limited, but is susceptible to variation and modification without departure from the scope and spirit of the invention.

I claim:

1. An improved assembly for steering a rotating drillstring in a borehole, the assembly comprising:

a stabilizer sub for attachment into a drillstring;

a stabilizer body rotatably carried by the stabilizer sub, wherein the stabilizer body remains substantially stationary relative to the borehole as the drillstring rotates;

at least one stabilizer blade carried by the stabilizer body, the stabilizer blade being radially extendable from the stabilizer body and into engagement with the sidewall of the borehole;

a yielding member coupled to each stabilizer blade for moving the stabilizer blade relative to the stabilizer body, the yielding member being constructed to yield in response to a selected axial load, to allow the stabilizer blade to collapse to minimal radial extension; and a non-hydraulic motor associated with the stabilizer blade assembly and carried by the stabilizer body for selective extension of the stabilizer blade.

2. The assembly according to claim 1 further comprising:

at least three stabilizer blades spaced apart on the circumference of the stabilizer body.

3. The assembly according to claim 1 wherein each stabilizer blade is carried in a longitudinal slot in the stabilizer body, the slot having an inclined bottom and relative longitudinal movement between the stabilizer blade and stabilizer body causes extension or retraction of the stabilizer blade.

4. The assembly according to claim 3 wherein the motor further comprises:

an electric motor coupled between each stabilizer blade and the stabilizer body to cause relative longitudinal movement therebetween.

5. The assembly according to claim 1 wherein the stabilizer sub includes a fixed stabilizer at an end opposite the drill bit.

6. The assembly according to claim 1 wherein the yielding member is a leadscrew.

7. An improved assembly for steering a rotating drillstring in a borehole, the assembly comprising:

a stabilizer sub for attachment into the drillstring adjacent a drill bit;

a stabilizer body rotatably carried by the stabilizer sub, wherein the stabilizer body remains substantially stationary relative to the borehole as the drillstring rotates;

at least a pair of generally opposed stabilizer blades carried by the stabilizer body, the stabilizer blades being radially extendable independently of one another from the stabilizer body and into engagement with the sidewall of the borehole;

a yielding member coupled to each stabilizer blade for moving the stabilizer blade relative to the stabilizer body, the yielding member being constructed to yield in response to a selected axial load, to allow the stabilizer blade to collapse to minimal radial extension; and at least a pair of motors carried by the stabilizer body, each motor associated with one of the stabilizer blades for selective extension of the stabilizer blade.

8. The assembly according to claim 7 wherein each stabilizer blade is carried in a longitudinal slot in the stabilizer body, the slot having an inclined bottom and relative longitudinal movement between the stabilizer blade and stabilizer body causes extension or retraction of the stabilizer blade.

9. The assembly according to claim 7 further comprising:

four stabilizer blades spaced apart on the circumference of the stabilizer body.

10. The assembly according to claim 9 wherein the stabilizer sub includes a fixed stabilizer at an end opposite the drill bit.

11. The assembly according to claim 9 wherein each motor further comprises:

an electric motor coupled between each stabilizer blade and the stabilizer body to cause relative longitudinal movement therebetween.

12. The assembly according to claim 9 wherein the stabilizer sub includes a fixed stabilizer at an end opposite the drill bit.

13. The assembly according to claim 7 wherein the yielding member is a leadscrew.

14. An improved assembly for steering a rotating drillstring in a borehole, the assembly comprising:

a stabilizer sub for attachment into the drillstring adjacent a drill bit;

a stabilizer body rotatably carried by the stabilizer sub, wherein the stabilizer body remains substantially stationary relative to the borehole as the drillstring rotates, at least one longitudinal slot formed in the exterior of the stabilizer, the slot having an inclined bottom;

at least one stabilizer blade carried in the slot in the stabilizer body, the stabilizer blade being radially extendable from the stabilizer body and into engagement with the sidewall of the borehole by longitudinal movement in the slot having the inclined bottom;

a yielding member coupled to each stabilizer blade for moving the stabilizer blade relative to the stabilizer body, the yielding member being constructed to yield in response to a selected axial load;

wherein the stabilizer blade is carried in the slot such that the yielding member yields in response to the selected axial load, which results from the stabilizer body becoming stuck in the borehole, thereby allowing the stabilizer blade to collapse to minimal radial extension;

an electric motor carried by the stabilizer body and coupled to the stabilizer blade to cause longitudinal movement of the stabilizer blade in the slot; and a source of electrical power carried by the stabilizer sub and in electrical communication with the motor.

15. The assembly according to claim 14 further comprising:

four stabilizer blades spaced apart in four longitudinal slots in the circumference of the stabilizer body; and four motors carried by the stabilizer body.

16. The assembly according to claim 14 wherein a lead screw couples the motor to the stabilizer blade, rotation of the lead screw by the motor causing longitudinal movement of the stabilizer blade in the slot.

17. The assembly according to claim 14 wherein the yielding member is a leadscrew.

* * * * *